US009485586B2

(12) United States Patent
Permanian

(10) Patent No.: US 9,485,586 B2
(45) Date of Patent: Nov. 1, 2016

(54) SPEAKER DRIVER

(71) Applicant: Jeffery K Permanian, Oconomowoc, WI (US)

(72) Inventor: Jeffery K Permanian, Oconomowoc, WI (US)

( * ) Notice: Subject to any disclaimer, the term of this patent is extended or adjusted under 35 U.S.C. 154(b) by 500 days.

(21) Appl. No.: 13/843,893

(22) Filed: Mar. 15, 2013

(65) Prior Publication Data

US 2014/0270323 A1 Sep. 18, 2014

(51) Int. Cl.

*H04R 9/04* (2006.01)
*H04R 9/02* (2006.01)
*H04R 9/06* (2006.01)

(52) U.S. Cl.

CPC ..... *H04R 9/043* (2013.01); *H04R 9/025* (2013.01); *H04R 9/06* (2013.01)

(58) Field of Classification Search

CPC ..... H04R 9/025; H04R 9/04; H04R 9/041; H04R 9/046; H04R 9/047; H04R 9/043; H04R 9/045

USPC ..... 381/394, 403, 405, 400, 395, 407, 424, 381/412, 419, 413, 421

See application file for complete search history.

(56) References Cited

U.S. PATENT DOCUMENTS 5,042,072 A 8/1991 Button
5,321,762 A 6/1994 Stuart
5,748,760 A 5/1998 Button
5,786,741 A 7/1998 Leibzon
5,898,786 A 4/1999 Geisenberger
6,568,503 B2 5/2003 Proni
6,626,263 B2 * 9/2003 Sahyoun ..... H04R 1/2834 181/157
6,636,612 B1 10/2003 North
6,735,322 B1 5/2004 Watanabe
6,768,806 B1 7/2004 Button
6,847,726 B2 1/2005 Button
7,203,333 B2 4/2007 Funahashi
7,209,570 B2 4/2007 Funahashi
7,324,659 B2 1/2008 Funahashi
7,379,558 B2 5/2008 Proni
7,423,506 B2 9/2008 Terasaki
7,443,996 B2 10/2008 Funahashi
7,532,736 B2 5/2009 Funahashi
7,539,323 B2 5/2009 Funahashi (Continued)

FOREIGN PATENT DOCUMENTS

EP 2192793 A1 2/2010
JP 2004312599 A 11/2004

(Continued)

OTHER PUBLICATIONS

Unknown, "Aura Sound 2 inch Extended Range Loudspeaker" specification sheet, available at http://www.madisound.com/store/manuals/NSW2-326-8A.pdf, Jul. 14, 2003.

(Continued)

*Primary Examiner* — Davetta W Goins
*Assistant Examiner* — Jasmine Pritchard
(74) *Attorney, Agent, or Firm* — Patricia A. Meier

(57) ABSTRACT

A speaker driver with a high degree of symmetry for use in a loudspeaker is disclosed. The disclosed motor assembly may be symmetrical about its long and radial axes. A voice coil disclosed may be supported by opposing upper and lower suspensions on the voice coil upper and lower ends. The upper and lower voice coil suspensions may be adhered to a frame above and below the motor assembly, respectively.

2 Claims, 8 Drawing Sheets

(56) References Cited

U.S. PATENT DOCUMENTS

| | | | | |
|---|---|---|---|---|
| 7,542,583 | B2 | 6/2009 | Funahashi | |
| 7,574,013 | B2 | 8/2009 | Funahashi | |
| 7,627,133 | B2 | 12/2009 | Funahashi | |
| 7,706,563 | B2 | 4/2010 | Stewart | |
| 7,822,222 | B2 | 10/2010 | Funahashi | |
| 7,844,071 | B2 | 11/2010 | Funahashi | |
| 7,929,724 | B2 | 4/2011 | Funahashi | |
| 7,974,434 | B2 | 7/2011 | Funahashi | |
| 7,995,788 | B2 | 8/2011 | Funahashi | |
| 8,005,253 | B2 | 8/2011 | Funahashi | |
| 8,009,856 | B2 | 8/2011 | Funahashi | |
| 8,041,068 | B2 | 10/2011 | Funahashi | |
| 8,041,069 | B2 | 10/2011 | Funahashi | |
| 8,081,791 | B2 | 12/2011 | Funahashi | |
| 8,085,970 | B2 | 12/2011 | Funahashi | |
| 8,094,862 | B2 | 1/2012 | Funahashi | |
| 8,160,286 | B2 * | 4/2012 | Koike | H04R 7/06 381/182 |
| 8,249,290 | B2 | 8/2012 | Funahashi | |
| 8,351,642 | B2 | 1/2013 | Funahashi | |
| 8,355,523 | B2 | 1/2013 | Funahashi | |
| 8,385,580 | B2 * | 2/2013 | Adamson | H04R 9/022 381/401 |
| 8,649,550 | B2 | 2/2014 | Shi | |
| 8,995,704 | B2 | 3/2015 | Huang | |
| 2004/0008859 | A1 | 1/2004 | Zhao | |
| 2004/0156527 | A1 * | 8/2004 | Stiles | H04R 9/063 381/412 |
| 2004/0252859 | A1 * | 12/2004 | Saiki | H04R 1/2819 381/386 |
| 2007/0160257 | A1 * | 7/2007 | Stiles | H04R 9/025 381/421 |
| 2008/0056527 | A1 * | 3/2008 | Adamson | H04R 9/022 381/409 |
| 2008/0170744 | A1 * | 7/2008 | Button | H04R 9/025 381/412 |
| 2010/0296688 | A1 | 11/2010 | Funahashi | |
| 2012/0051581 | A1 | 3/2012 | Danovi | |
| 2013/0266173 | A1 * | 10/2013 | Niedermann | H04R 9/02 381/400 |

FOREIGN PATENT DOCUMENTS

| | | | |
|---|---|---|---|
| JP | 3651454 | B2 | 5/2005 |
| JP | 3651455 | B2 | 5/2005 |
| JP | 3651481 | B2 | 5/2005 |
| JP | 3651482 | B2 | 5/2005 |
| JP | 3651483 | B2 | 5/2005 |
| JP | 2005252925 | A | 9/2005 |
| JP | 2005252926 | A | 9/2005 |
| JP | 3843901 | B2 | 11/2006 |
| JP | 2007110208 | A | 4/2007 |
| JP | 2009135858 | A | 6/2009 |
| JP | 4353015 | B2 | 10/2009 |
| JP | 4442255 | B2 | 3/2010 |
| JP | 2010206558 | A | 9/2010 |
| JP | 2010206560 | A | 9/2010 |
| JP | 5167874 | B2 | 3/2013 |
| JP | 5278045 | B2 | 9/2013 |

OTHER PUBLICATIONS

Unknown, "Speaker Primer," vol. 1, No. 1, 1994, Revised Jul. 2003, available at http://www.hometheaterhifi.com/volume_1_1/v1n1spk.html.

Unknown, "LSR6300 Studio Monitors mix without boundaries," brochure, 2006, available at http://www.jblpro.com/ProductAttachments/DOC_561.pdf.

Unknown, "Aurasound Technology—the Sound of the Furture" webpage, downloaded Jul. 18, 2012, available at http://aurasound.flyinghstudios.com/technology.html.

Unknown, The American Heritage Disctionary, 1992, p. 752, Houghton Mifflin Compay, New York, U.S.

Wolfgang Klippel, Dynamical Measurement of Loudspeaker Suspension Parts, Audio Engineering Society Convention Paper 6179, Oct. 28-31, 2004, pp. 1-20.

Rod Elliott, Loudspeaker Power Handling Vs. Efficiency, Elliott Sound Products article, Rod Elliott, Dec. 16, 2006, pp. 1-17, available at http://sound.westhost.com/.

Ahmet Feyz Pirimoglu, The Effect of Faraday Ring (Shorting Ring) Usage on Voice Coil Impedance and Its Benefits, e-book, Aug. 2, 2005, p. 1-37, available at www.avbook.in.

Wolfgang Klippel, Tutorial: Loudspeaker Nonlinearities—Causes, Parameters, Symptoms, J. Audio Eng. Soc., vol. 54, No. 10, Oct. 2006, pp. 907-939.

Unknown, AN 26 Nonlinear Stiffness of Suspension Parts, Application Note, Apr. 4, 2012, pp. 1-8, available at https://www.klippel.de/.

Wolfgang Klippel, "Loudspeaker Nonlinearities—Causes, Parameters, Symptoms," Audio Engineering Society Convention Paper 6584, Oct. 7-10, 2005, pp. 1-36, AES 119th Convention, New York, New York.

* cited by examiner

FIG. 1
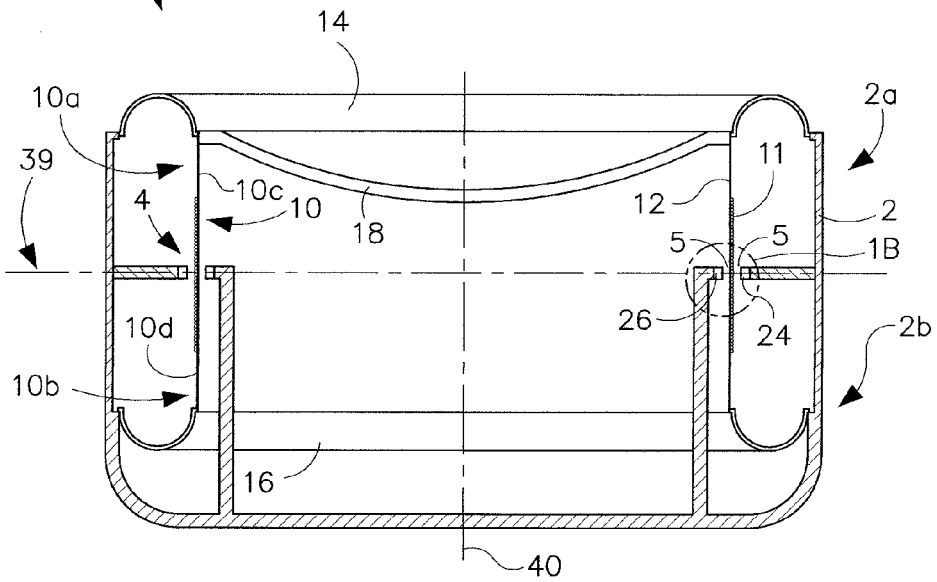
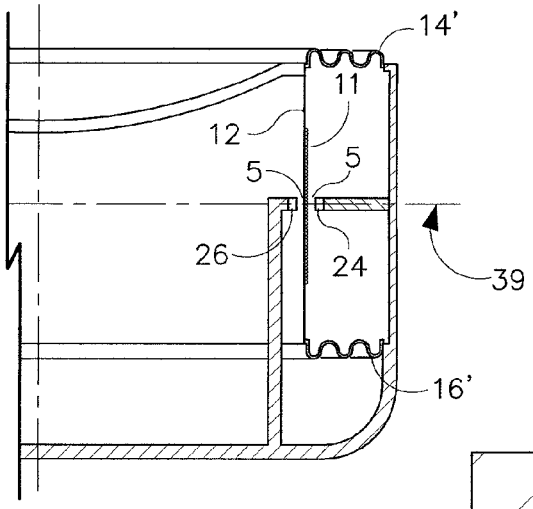
FIG. 1A
FIG. 1B
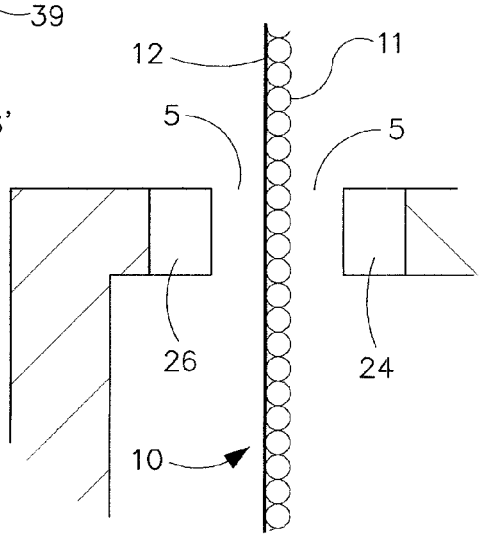

SPEAKER DRIVER

CROSS-REFERENCE TO RELATED APPLICATIONS

None

BACKGROUND OF THE DISCLOSURE

1. Field of the Disclosure

The disclosure relates to speaker drivers and more particularly, to a speaker driver with a symmetrical motor assembly and a symmetrical voice coil support system.

2. Background of the Disclosure

Speaker drivers generally comprise a frame, a motor assembly, a voice coil and a moving assembly. In a pancake style speaker driver, the motor assembly includes a bottom plate supporting a pole piece about which the permanent magnet is concentrically disposed. The top plate, bottom plate and pole piece are typically made of ferromagnetic material. A magnetic gap is formed between the pole piece and the top plate.

The voice coil typically includes a concentrically wound wire around a bobbin known as a former. The voice coil is concentrically hung from its upper end within the magnetic gap of the driver by a moving assembly. When electrical signals from an amplifier pass through the voice coil, it turns into an electromagnet. As the current oscillates, the voice coil moves inwardly and outwardly, pushing the moving assembly. The moving assembly typically includes a surround, a spider and a cone. The surround supports and centers the cone. The surrounds, spider and cone serve to hang the voice coil and center it within the magnetic gap as pushes and pulls air, transforming the electrical signal into sound.

SUMMARY OF THE DISCLOSURE

The present disclosure provides a speaker driver comprising a motor assembly wherein the motor assembly may be substantially symmetrical about a radial axis and a long axis. Another aspect disclosed is a magnetically symmetrical motor assembly. The present disclosure also provides a speaker driver comprising a voice coil with an upper end and a lower end wherein the voice coil may be supported at its upper and lower ends. In a preferred embodiment, the speaker driver may have a motor assembly and a voice coil support system that may be symmetrical about its long and radial axes.

One aspect of the disclosure provides a speaker driver comprising a frame with motor assembly disposed within the frame. A voice coil may be disposed moveably within a magnetic gap formed within the motor assembly. The voice coil, in one aspect of this disclosure, may be supported from both its lower and upper ends. An upper suspension may be adhered to the outer periphery of the voice coil and the frame above the motor assembly. A lower suspension may be adhered to the outer periphery of the voice coil and the frame below the motor assembly and a cone may be adhered to an inner periphery of the voice coil above the motor assembly. In another aspect of this disclosure, the motor assembly may be substantially symmetrical about a radial axis. In yet another aspect of this disclosure, a voice coil support system may comprise upper and lower suspensions, which are substantially symmetrical about the long axis of the speaker driver. Further still, the speaker driver may comprise a motor assembly and a voice coil support system that may be symmetrical about the radial and long axes of the speaker driver. The speaker driver frame may be made of metal or composite. Preferably, the speaker driver frame may be non-ferromagnetic. More preferably, the speaker driver frame may be aluminum.

The present disclosure, in another aspect, presents a speaker driver having a voice coil with a diameter larger than that of the speaker driver's cone, known in the art as an outside coil. In one embodiment, the winding of the voice coil may be in the inner periphery of the former. This embodiment of the voice coil is known in the art as an inside voice coil. In another embodiment, the winding may be in the inner periphery of the former and on the outer periphery of the former. This embodiment of the voice coil is known in the art as an inside/outside voice coil. In preferred embodiments, the diameter of the voice coil may be from about ninety percent to about one hundred and ten percent of the diameter of the cone. In another preferred embodiment, the diameter of the voice coil is larger than the diameter of the cone. In other aspects, the voice coil may be underhung, wherein the length of the winding is from about ten percent to about ninety-nine percent or evenhung wherein the length of the winding is substantially one hundred percent. The voice coil may preferably be overhung, wherein the length of the winding is greater than the length of the magnetic gap, preferably from about 200 hundred percent to 2000 percent.

The speaker driver disclosed herein may employ a voice coil having a long length in relationship to the length of the former and the length of the speaker driver long axis. In one embodiment, the speaker driver comprises a voice coil winding from about twenty percent to about ninety percent the length of the former. In another embodiment, the voice coil comprises a winding wherein the length of the winding may be from about thirty percent to about eighty percent of the length of the speaker driver along its long axis. Preferably, the winding length may be from about fifty percent to about seventy percent of former length and the former length may be from about forty percent to about sixty percent of the speaker driver length. Naturally, the speaker driver of this disclosure may employ any combination of these length ratios.

Another aspect disclosed may be a voice coil support system having at least two suspensions wherein at least one suspension may be adhered to the speaker driver frame above the motor assembly and at least one suspension may be adhered to the speaker driver frame below the motor assembly. In one preferred aspect, the upper and lower suspensions have arcuate shapes. More preferably, the upper suspension and lower suspensions have opposing arcuate shapes, which, in a further aspect, may be substantially symmetrical about the radial axis. The suspensions may have a variety of shapes, such as half rolls, progressive rolls and corrugated shapes, which may be, in another aspect, arranged in an opposing manner about the radial axis of the speaker driver. Regardless of the number of suspensions used in the disclosed speaker driver, it is preferable to have an even number of suspensions with substantially similar shapes arranged substantially symmetrically about the radial axis 39 of the speaker driver 1 like mirror images.

Another embodiment disclosed is a speaker driver comprising a frame, having an upper end and a lower end; a motor assembly disposed within the frame; and a voice coil, comprising a winding on the outer periphery of a former. The voice coil may be disposed for axial movement within a magnetic gap concentrically formed within the motor assembly. The former, having an upper end, a lower end, an inner periphery and an outer periphery; may be adhered to the upper suspension's inner edge along the outer periphery of the former at the former's upper end. The upper suspension's outer edge may be adhered to the upper end of the frame above the motor assembly. A cone may be adhered to the inner periphery of the former at the upper end of the former. The lower suspension's inner edge may be adhered to the outer periphery of the former at the lower end of the former, while the lower suspension's outer edge may be adhered to the lower end of the frame below the motor assembly.

The present disclosure, in one aspect, provides a voice coil support system for use in a speaker driver comprising an upper suspension and a lower suspension opposingly adhered to opposing ends of the voice coil. Preferably, the opposingly adhered upper and lower suspensions have opposing symmetrical shapes. More preferably, at least two suspensions are adhered to opposing ends of the voice coil wherein the voice coil support system may be substantially symmetrical about its long and radial axes. The voice coil support system may be further configured to adhere to the speaker driver frame in a manner, which may be symmetrical about the long axis of the speaker driver. In another preferable embodiment, the voice coil support system comprises an upper suspension, a lower suspension and a former, the former having an upper end, a lower end and an outer periphery wherein the upper suspension may be adhered to the outer periphery of the former at the upper end of the former and the lower suspension may be adhered to the outer periphery of the former at the lower end of the former wherein the voice coil support system may be substantially symmetrical about its long axis and radial axis.

In a preferred embodiment, a voice coil support assembly for a speaker driver comprises a former having an upper end, a lower end and an outer periphery; an upper suspension having an inner edge and an outer edge wherein the inner edge of the upper suspension may be adhered to the outer periphery of the former at the upper end of the former and the outer edge of the upper suspension may be adapted for adhesion to the upper end of a frame above a motor assembly; a lower suspension having an inner edge and an outer edge wherein the inner edge of the lower suspension may be adhered to the outer periphery of the former towards the a lower end of the former and the outer edge of the lower suspension may be adapted for adhesion to a lower end of a frame below the motor assembly.

This disclosure presents a symmetrical motor assembly. In one aspect, the motor assembly for a speaker driver may comprise annular rings. Preferably, the concentric annular rings may be made from a plurality of radially polarized magnets. Although the motor assembly preferably comprises annular rings made from a plurality of radially polarized arc magnets, one-piece annular permanent magnets may also be used for either the first or second magnet system or both. In one embodiment a motor assembly may comprise a first magnet system fixed in an annular ring forming an inner diameter and an outer diameter; a second magnet system fixed in an annular ring forming an inner diameter and an outer diameter wherein the outer diameter of the second magnet system is smaller than the inner diameter of the first magnet system and a magnetic gap formed between the inner diameter of the first magnet system and the outer diameter of the second magnet system whereby the first magnet system and the second magnet system are operatively coupled by magnetic flux wherein at least one magnetic system comprises a plurality of radially polarized arc magnets. In a preferred embodiment, the motor assembly comprises a first magnet system comprising a plurality of radially polarized arc shaped permanent magnets fixed in an annular ring, may form an inner diameter and an outer diameter. A second magnet system may also comprise a plurality of radially polarized arc shaped permanent magnets fixed in an annular ring forming an inner diameter and an outer diameter. In further aspects, the size of the magnetic systems disclosed may comprise a second magnet system with an outer diameter that is smaller than the inner diameter of the first magnet system. A magnetic gap may be formed between the inner diameter of the first magnet system and the outer diameter of the second magnet system whereby the first and second magnet systems are operatively coupled by a magnetic flux. In aspects, the motor assembly may comprise radially polarized arc magnets forming the annular ring may have from about one to about forty-five degrees of arc. Preferably, the first and second magnetic systems each comprise 36 arc magnets of ten degrees of arc. In a preferred aspect, the motor assembly may be symmetrical about its long and radial axis. In another preferred aspect, the motor assembly may be symmetrically arranged within a speaker driver along its long axis.

This disclosure also provides a frame for a speaker driver comprising at least three j-shaped members, hereinafter called j-beams. Each j-beam may have an upper end, a lower end, a shank area, a hook area and a recess, the recess being formed within an inner periphery of the shank area near the lower end of the j-beam, before the bend of the j-shape. The lower end of the j-beam preferably has a base. The upper end of the j-beam on the hook area may be adapted for attaching an upper ring. Alternatively, the upper ring may be integrally formed with the j-beam. The upper ring may have an inner edge, an outer edge, a top surface and a bottom surface. The upper ring may be adapted to for mounting the at least three j-beams substantially equidistant in a polygonal arrangement with the hook areas of the j-beams arranged inwardly of the outer edge of the upper ring. The frame may also have a lower ring with an inner edge and an outer edge. The outer edge of the lower ring may be held within the recesses of the at least three j-beams shank area. This disclosure also presents an outer ring having an inner edge and an outer edge. The outer edge of the outer ring may be attached to the inner periphery of the shank area of at least three j-beams. Preferably, the outer ring may be attached substantially equidistant from the upper ring and the lower ring. The frame may also use an inner ring adapted for mounting on the upper end of the hook area of at least three j-beams. The inner ring may be preferably concentrically aligned with the outer ring.

The present disclosure also presents a speaker driver comprising a frame having at least three j-beams. In a preferred embodiment, six j-beams may be used. Each j-beam may have an upper end, a lower end, a shank area, a hook area and a recess, the recess being formed within an inner periphery of the shank area near the lower end of the j-beam. The lower end of the j-beam preferably has a base.

An upper edge on the shank area may provide a surface for attaching an upper ring. The upper ring may have an inner edge, an outer edge, a top surface and a bottom surface. The upper ring may be adapted for mounting the at least three j-beams substantially equidistant from each other in a polygonal arrangement. The hook areas of the j-beams may be arranged inwardly of the outer edge of the upper ring.

A lower ring having an inner edge and an outer edge may be held within the recess of the shank area of at least three j-beams by the outer edge of the lower ring, which may add rigidity to the frame and provide a surface for adhering a lower suspension. An outer ring having an inner edge and an outer edge, the outer edge of the outer ring may be attached to the inner periphery of the shank area of the j-beam, providing additional rigidity to the frame. Preferably, the outer ring may be located substantially equidistant between the upper ring and the lower ring. The inner edge of the outer ring may be adapted for mounting the first magnet system. An inner ring having an inner edge and an outer edge may be attached to the upper end of the hook area of the j-beam. The inner ring may be preferably aligned concentrically with the outer ring. The inner ring may be adapted for mounting a second magnet system on its outer edge.

The first magnet system, in other aspects, may be attached to the inner edge of the outer ring. A second magnet system may be attached to the outer edge of the inner ring. A magnetic gap may be formed between the first magnet system and the second magnet system, wherein the first magnet system and second magnet system form a radially aligned motor assembly. A voice coil may be disposed moveably within the magnetic gap providing axial movement. The voice coil may comprise at least one winding wound over a former. The former, having an upper end, a lower end, an inner periphery and an outer periphery may be used to adhere an upper suspension. The upper suspension having an inner edge may be adhered to the outer periphery of the former at the upper end of the former. The outer edge of the suspension may be adhered to the inner edge of the upper ring above the motor assembly. A cone may be adhered to the inner periphery of the former at the upper end of the former. A lower suspension having an inner edge may be adhered to the outer periphery of the former at the lower end of the former. The outer edge of the lower suspension may be adhered to the inner edge of the lower ring below the motor assembly. In a further aspect, the speaker driver may have a first magnet system and second magnet system comprising a plurality of arc magnets.

NOTATION AND NOMENCLATURE

It should be understood that examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

The following discussion and in the claims, the terms "including" and "comprising" are used in an open-ended fashion, and thus should be interpreted to mean "including, but not limited to . . . ".

Singular or plural number(s) may also include the plural or singular number respectively.

The word "or" in reference to a list of two or more items, that word covers all of the following interpretations of the word: any of the items in the list, all of the items in the list, and any combination of the items in the list.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings, not drawn to scale, in which like reference characters designate like or similar elements throughout the several figures of the drawing and wherein:

FIG. 1 is a cross-sectional view of one embodiment of a speaker driver of this disclosure.

FIG. 1A is a cross-sectional view of an embodiment of a speaker driver of this disclosure using a multiple roll suspension.

FIG. 1B is a detail of FIG. 1 expanded to illustrate the voice coil placement, including its winding and former, within the magnetic gap formed within the first and magnet systems of the motor assembly.

DETAILED DESCRIPTION OF THE PREFERRED EMBODIMENTS

Figure 2:
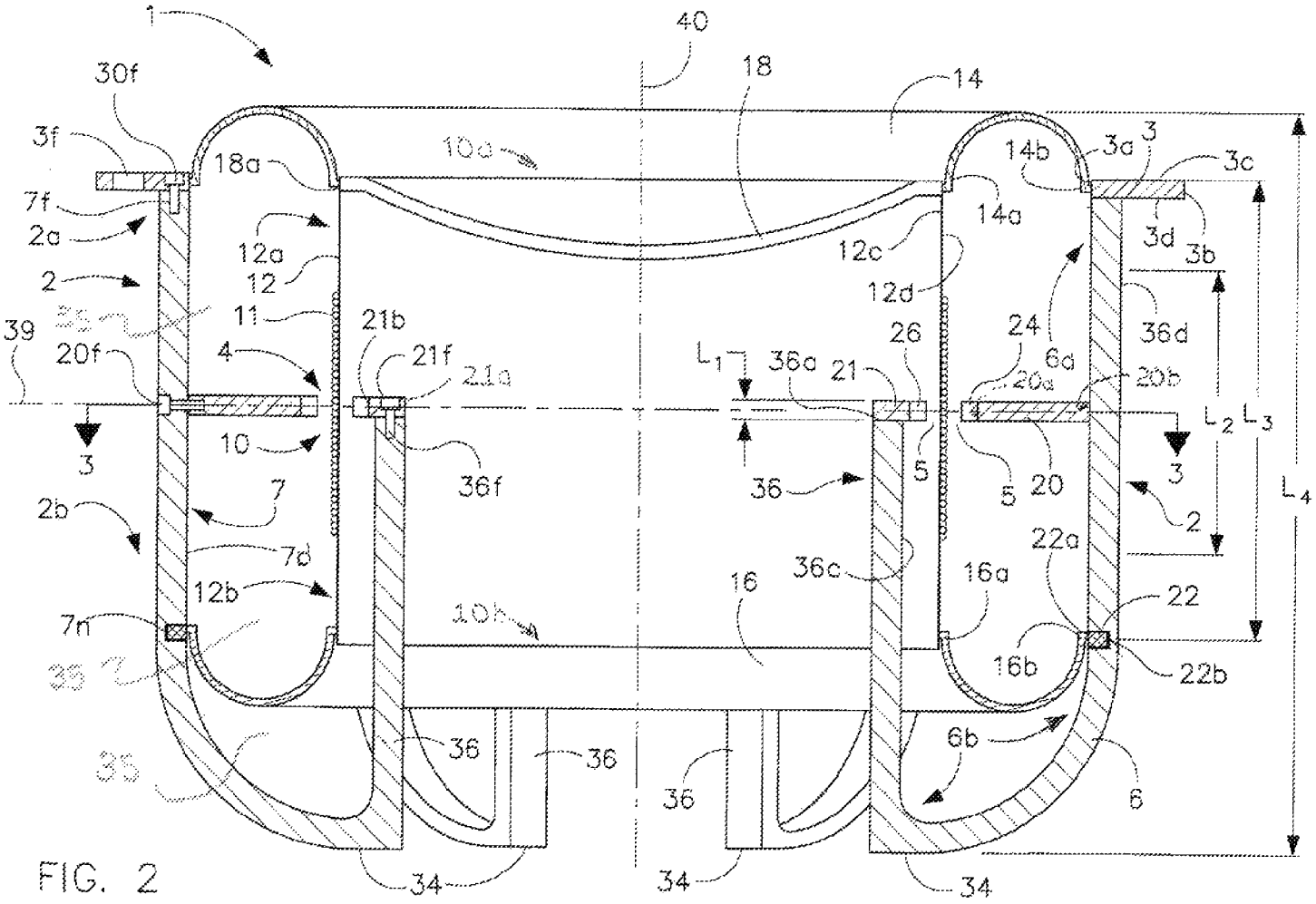
FIG. 2 is a cross-area view of another embodiment of a speaker driver of this disclosure illustrating use of fasteners on the left side of the long axis and adhesive attachment on the right.

The present disclosure in broad aspects, relates to a speaker driver. In other aspects, it relates to a motor assembly, a voice coil support system and a frame, which may be used in the driver. The present disclosure is susceptible to embodiments of different forms. There are shown in the drawings, which will be described herein in detail, specific embodiments of the present disclosure with the understanding that the present disclosure is to be considered an exemplification of the principles of the disclosure and is not intended to limit the disclosure to that illustrated and described herein. The use of "upper," "lower," "inner," "outer," "top," "bottom," "inside," "outside" and the like refer to the orientation of the speaker driver as it appears in the Figures. Further, while embodiments may be described as having one or more features or a combination of two or more features, such a feature or a combination of features should not be construed as essential unless expressly stated as essential.

Referring now to the drawings, two alternative embodiments of the speaker driver 1 are illustrated in FIG. 1 and FIG. 1A. FIG. 1 is a cross-sectional view of one embodiment of the disclosed speaker driver 1. The speaker driver 1 includes a frame 2; a motor assembly 4; a voice coil 10, an upper suspension 14, a lower suspension 16 and a cone 18.

The concentrically disposed voice coil 10 is typically made by winding wire around a bobbin, known as the winding 11 and former 12, respectively. The winding comprising at least one wire wound about the former 12 leaves the upper end and lower ends (10*a*, 10*b*) ends of the voice coil 10 bare for adhesion to the suspensions 14, 16 and the cone (18). In aspects, the voice coil 10 of embodiments of this disclosure may be inside coils (not shown), outside coils or inside outside voice coils (not shown). The motor assembly 4 comprises two annular magnet systems 24, 26 concentrically disposed within the frame 2. The voice coil 10 is shown substantially bisecting a magnetic gap 5 formed between the two magnet systems 24, 26.

Continuing, FIG. 1 illustrates another embodiment having an upper suspension 14 and lower suspension 16 adhered to the upper and lower ends of the frame 2*a*, 2*b* on opposite sides of the motor assembly 4. Suspensions typically used in the art are commonly called surrounds and spiders. Surrounds are generally made from a foam or butyl rubber. Surrounds may have be cupped, flat, corrugated or have progressive rolls. A preferred arcuate shape for a surround may be a half-roll, but more preferably progressive rolls. Spiders are typically corrugated and made from a stiffer material, preferably fabrics such as cotton, polypropylene or Nomex®. FIG. 1A illustrates an embodiment having corrugated suspensions. A preferred embodiment may use spiders of Nomex® having progressive rolls. Both suspension types have inner and outer circumferential edges for adhesion to the voice coil 10 and frame 2, respectively. As illustrated in FIG. 1 and FIG. 1A, the upper (14, 14') and lower suspensions (16, 16') of these embodiments may be respectively adhered between the voice coil 10 at the upper and lower ends 10*a*, 10*b* of the voice coil 10 and frame 2 on opposite sides of the motor assembly 4 allowing the voice coil 10 to move up and down the long axis 40. FIG. 1 and FIG. 1A also illustrate use of opposing suspensions 14, 16. The suspensions 14, 16 may have arcuate shapes, which mirror each other symmetrically about the long and radial axes (40, 39) of the speaker driver 1. In another embodiment, the upper suspension 14 may be adhered to the outer periphery 10*d* of the voice coil 10 and the frame 2 above the motor assembly 4. In a further aspect of this embodiment, the lower suspension 16 may be adhered to the outer periphery 10*d* of the voice coil 10 and the frame 2 below the assembly 4.

Figures 4, 4A:
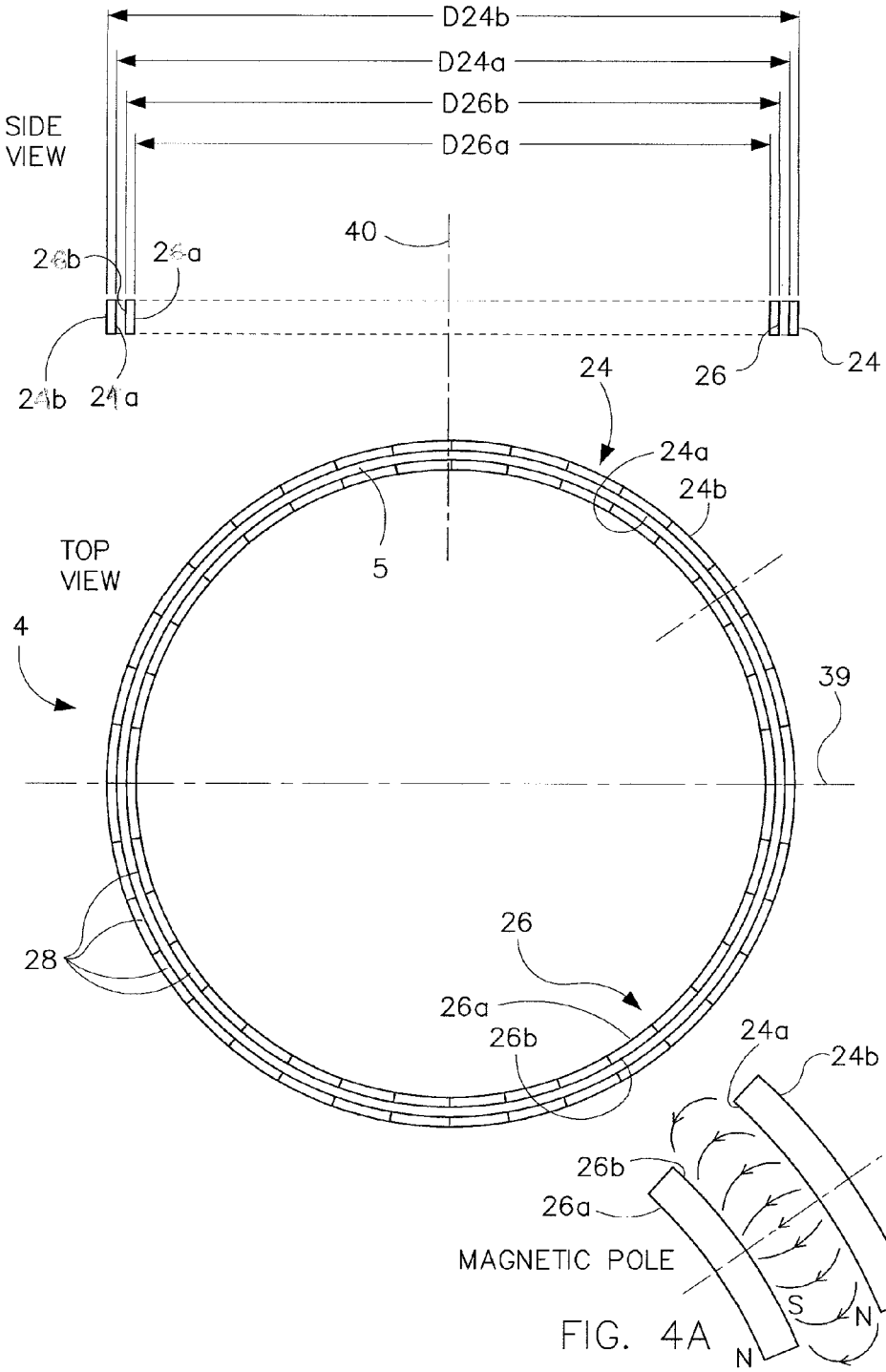
FIG. 4 is a cross-sectional side and top views of a motor assembly of this disclosure.
FIG. 4A is an expanded view of a portion of an embodiment of a motor assembly illustrating the magnetic flux lines between the magnet systems of a motor assembly of this disclosure.

The motor assembly 4 illustrated in FIG. 1 comprises two permanent annular ring magnets systems disposed concentrically within the frame 2. The permanent annular ring magnets systems 24, 26 may be high-grade ferrite, strontium or AlNiCo alloys; however, neodymium is preferred. The first magnet system 24 may be disposed outside the second magnet system 26. An embodiment of the motor assembly 4 illustrated in FIG. 1 is symmetrical about the long axis 40 and radial axis 39 of the speaker driver 1. Unlike prior art speaker drivers, having magnetic return paths through magnetically conducting top plates, pole pieces and sidewalls, preferred embodiments of this disclosure may use materials which do not conduct magnetically. The result may be a substantially symmetrical magnetic flux within the magnetic gap as depicted in FIG. 4A. FIG. 1 also illustrates an embodiment of an overhung voice coil 10 wherein the amount of winding 11 above and below the motor assembly 4 about the long axis 40 of the driver 1 may be substantially equal. When electrically excited, the amount of winding within the magnetic flux may be substantially constant resulting in an electrically symmetrical motor assembly 4.

The cone 18 of the driver 1 may be circumferentially adhered to the inner periphery 10*c* of the voice coil 10 at the upper end 10*a* of the voice coil 10. Typical cone materials are paper, PMI (closed cell polymethacrylimide available from Evonik, HCL (HoneyCombLaminate), pearl mica, thermalum, aluminum and titanium coated polypropylene, PBO fiber, and various fabrics such as Nomex®, Kevlar® and Mylar® available from DuPont. When electrical signals from an amplifier (not shown) pass through the voice coil 10, it turns into an electromagnet. As the current in the voice coil 10 oscillates, its polarity reverses and the voice coil 10 is alternately attracted to and repealed by fixed poles of the first and second magnet systems 24, 26. The voice coil 10 thus moves up and down the long axis 40 of the speaker driver 1, pushing and pulling the cone 18, which pushes and pulls air, transforming the electrical signal into sound.

Figure 3:
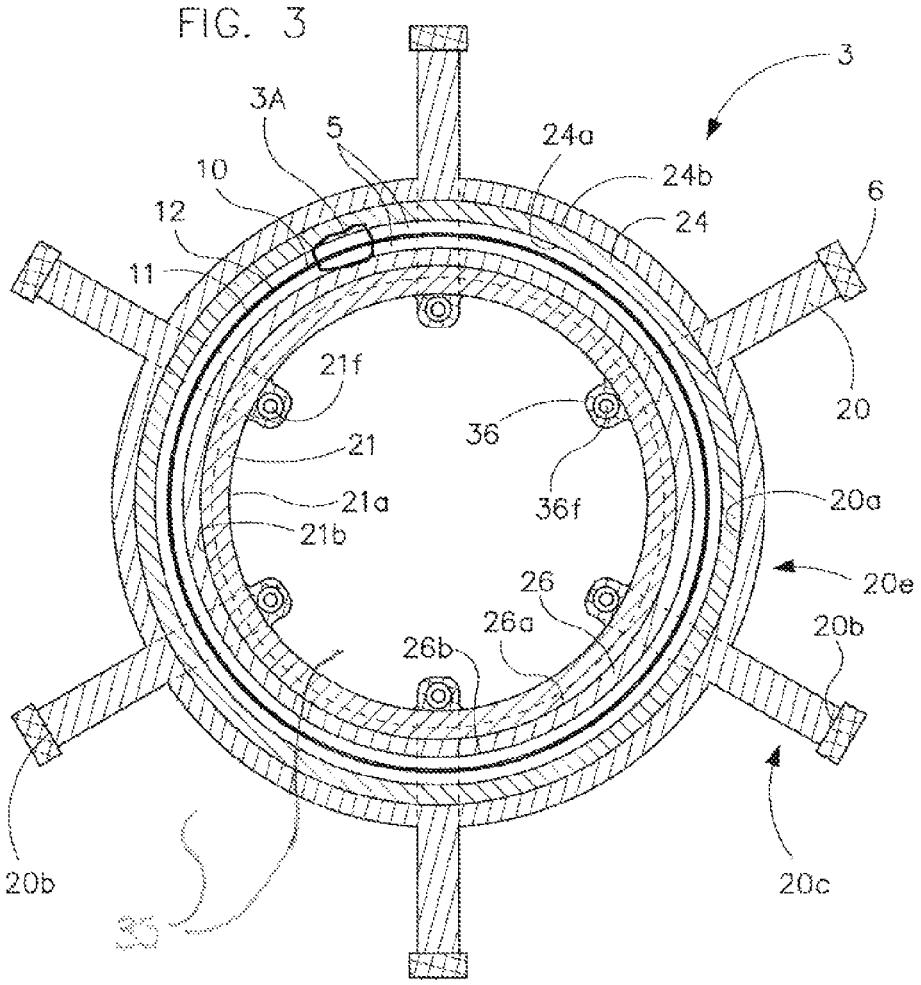
FIG. 3 is a cross-area view of FIG. 2 taken along line 3-3.
Figure 6E:
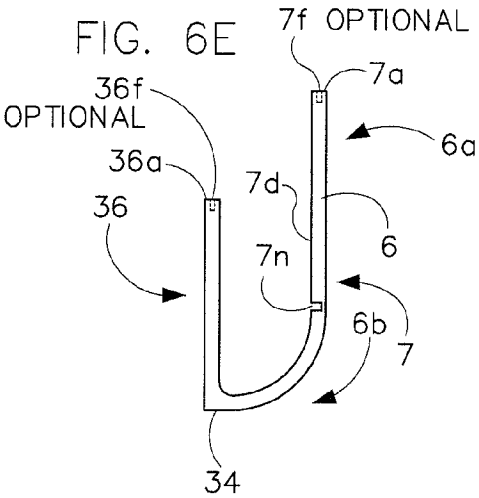
FIG. 6E is a cross-sectional side view of a j-beam of a frame embodiment of this disclosure.
Figure 6D:
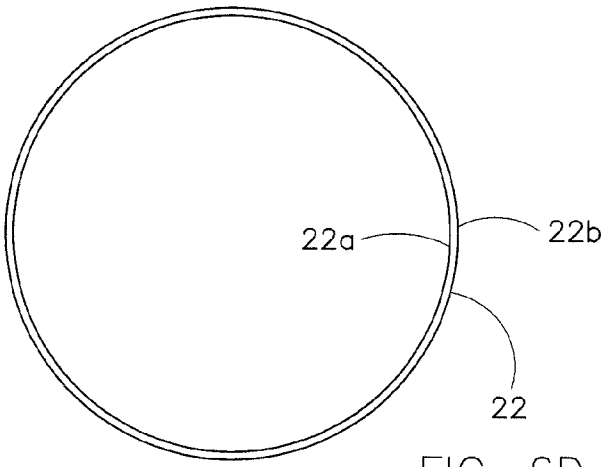
FIG. 6D is a cross-sectional top view of a lower ring of a frame embodiment of this disclosure.
Figure 6C:
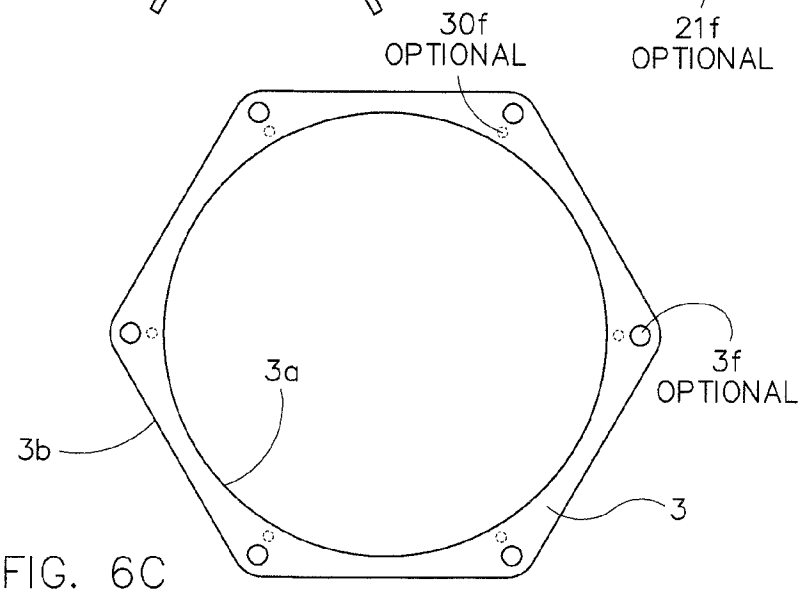
FIG. 6C is a cross-sectional top view of an upper ring of a frame embodiment of this disclosure.
Figure 7:
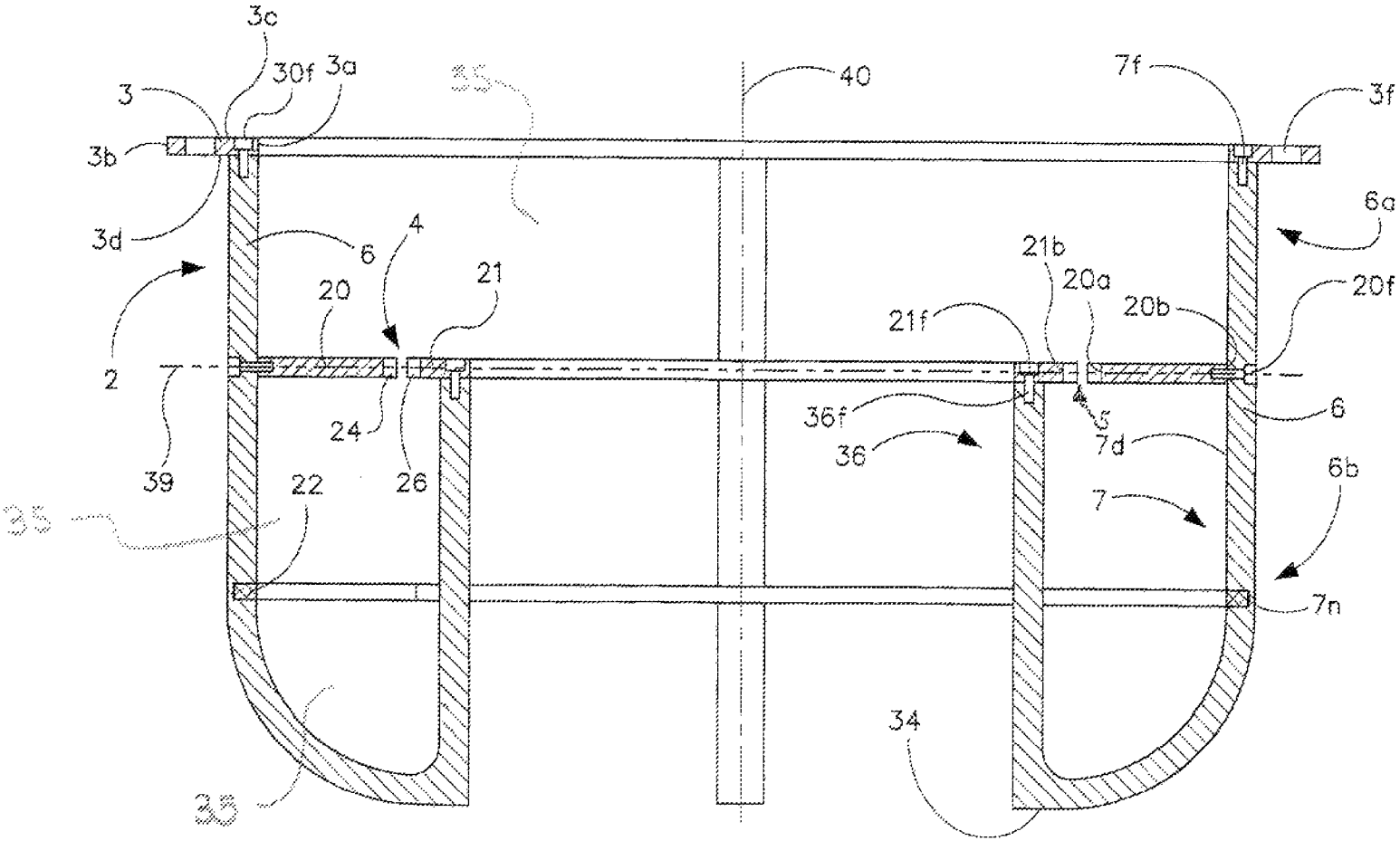
FIG. 7 is a cross-sectional view of an embodiment of an assembled frame of this disclosure using four j-beams.

Referring now to FIG. 2, a speaker driver 1 having a frame 2 comprising six j-beams 6 is illustrated. The j-beam, as depicted in FIG. 6E, may have a an upper end 6*a*, a lower end 6*b*, a shank area 7, a recess 7*n* within the j-beam inner periphery 7*d*, and a hook area 36. The lower end 6*b* of the j-beam 6 has a base 34 illustrated by the flattened area. Referring again to FIG. 2, the frame 2 may be assembled using at least four rings, an upper ring 3, a lower ring 22, an outer ring 20 and an inner ring 21. The j-beams 6 are aligned with the long axis and radially spaced apart from one another. Preferably the j-beams are arranged equidistant from each other as seen in FIGS. 2-3 and 7. The spaced apart j-beams form large air gaps 35 in the frame 2 most clearly depicted in FIGS. 2 and 7. The four rings may be attached to the j-beams 6 using means known in the art, e.g., fasteners, adhesive, welding and the like. FIG. 2 illustrates use of fasteners for rings 3, 20 and 21 left of the long axis 40 and adhesive on the right side of the long axis 40. Use of welding is not shown. FIG. 6*c* illustrates an upper ring 3 adapted for mounting six j-beams in a hexagonal arrangement. The perimeter of the outer edge 3*b* of the upper ring 3 may be shaped as desired for mounting the speaker driver 1 into a speaker cabinet (not shown) using fasteners through optional openings 3*f*.

The lower ring 22 may be used to secure the lower ends of the j-beams 6*b* as seen in FIG. 2. The hook areas 36 of the j-beam 6 may be preferably arranged interiorly from the outer edge (3*b*) and the inner edge (3*a*) of the upper ring 3 of the j-beam 6 before inserting the outer edge 22*b* of the lower ring 22 into the shank recess 7*n*. The lower ring 22 may be preferably attached by adhesive within the shank recess 7*n* for extra stability. The inner edge 22*a* edge of the lower ring 22 may be adapted for attaching the outer circumferential edge of the lower surround 16*b*, preferably using adhesive. The inner edge 22*a* of the lower ring 22 may protrude interiorly from the shank section 7 or the length of the inner ring 22 may be less than the length of the shank recess 7*n* to facilitate adhering the outer circumferential edge 16*b* of the lower suspension 16 to the inner edge 22*a* of the inner ring 22.

As illustrated in FIG. 2, the outer ring 20 may be used to attach the first magnet system 24. The first magnet system 24 may be preferably attached to the inner edge 20*a* of the outer ring 20. FIG. 6A is a cross-area view of the outer ring 20. The outer ring 20 may be annular shaped, but preferably has a hoop and spoke design. The outer edge 20*b* of the spoke area 20*c*, or the outer edge 20*b* of the hoop area 20*e* if an annular ring rather than a spoke and hoop embodiment is used, of the outer ring 20 may be attached to the inner periphery 7*d* of the shank area 7 by adhesive as illustrated on the right side of the long axis 40 in FIG. 2 or using fasteners as illustrated on the left side of the long axis 40 in FIG. 2. The outer ring 20 may be attached to the inner periphery 7*d* of the shank area 7 substantially midway between the upper ring 3 and the lower ring 22.

The inner ring 21 may be used to attach the second magnet system 26. The second magnet system 26 may be preferably attached to the outer edge 21*b* of the inner ring 21. The inner ring 21 may be mounted on the upper edge 36*a* of the hook area 36 of the j-beam 6. The inner ring 21 may be attached using adhesive or may be attached using fasteners as illustrated on the right and left side of the long axis 40 in FIG. 2.

Continuing with FIG. 2, the cone 18 may be adhered to the voice coil 10 at the upper end 12*a* of the former 12 on the inner periphery 12*c* of the former 12. An embodiment illustrated in FIG. 2 has a suspension system of surrounds and/or spiders supporting the upper end 10*a* and lower end 10*b* of the voice coil 10 by adhesion to the outer periphery 12*d* of the former 12 of the voice coil 10 at the upper end 12*a* of the former 12 and by adhesion to the outer periphery 12*d* of the former 12 of the voice coil 10 at the lower end 12*b* of the former 12. The upper suspension 14 depicted in FIG. 2 is a half roll. In this embodiment, the outer edge 14*b* of the upper suspension 14 may be adhered to the inner edge 3*a* of the upper ring 3 above the motor assembly 4. The inner edge 14*a* of the upper suspension 14 may be adhered to the upper end 12*a* of the former 12 of the voice coil 10 along the outer periphery 12*d* of the former 12 of the voice coil 10. The outer edge 16*b* of the lower suspension 16 may be adhered to the inner edge 22*a* of the lower ring 22 below the motor assembly 4. The inner edge 16*a* of the lower suspension 16 may be adhered to the lower end 10*b* of the voice coil 10 along the outer periphery 12*d* of the former 12 of the voice coil 10 at the lower end 12*b* of the former 12 of the voice coil 10. Thus, in aspects, the voice coil 10 of this embodiment may be supported by adhesion of at least two suspensions, at least one on its upper end 10*a* and at least one on its lower end 10*b*. In some embodiments upper and lower suspensions of may be of dissimilar shape (not shown). FIG. 2 illustrates an upper suspension 14 having a half roll substantially similar to the lower suspension 16. Preferably, the upper and lower suspensions 14, 16 are adhered to oppose each. More preferably, the upper suspension 14 and the lower suspension 16 are symmetrically opposed about their long and radial axes, like a mirror as illustrated in FIG. 2.

The lengths of the magnet gap $L_1$, the winding $L_2$, the former $L_3$ and the speaker driver $L_4$ are illustrated in FIG. 2. The voice coil 10 of this illustrated embodiment is overhung, having a winding length $L_2$ longer than the magnetic gap length $L_1$. Although the speaker driver 1 of this disclosure may use an underhung voice coil 10, wherein the winding length $L_2$ is shorter than the magnetic gap length $L_1$ or an evenhung voice coil wherein the winding length $L_1$ is substantially equal to 100 percent of the magnet gap length $L_1$ using an overhung voice coil 10 may be preferred. The winding length $L_2$ may be at least twenty percent the length of the former $L_3$ and may be from about thirty percent to about eighty percent of the length of the speaker driver $L_4$. The winding length $L_2$ may be preferably configured to have the same amount of winding within the magnetic gap 5 corresponding to the maximum designed excursion of the cone 18.

Figure 3A:
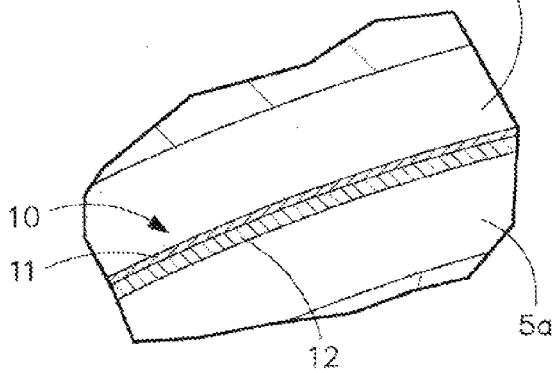
FIG. 3A is a detail of FIG. 3 expanded to illustrate the voice coil placement within the magnetic gap.

FIG. 3 is a cross-sectional top view of the speaker driver 1 embodiment in FIG. 2 taken along the section line 3-3. FIG. 3 illustrates the radial symmetry of the speaker driver 1. Reviewing the elements from the outermost to the innermost, one may see the j-beam 6; the outer edge 20*b* of the outer ring 20, the outer ring 20 (including the spoke area 20*c* and the hoop area 20*e*), the inner edge 20*a* of the outer ring 20; the outer edge 24*b* of the first magnet system 24, the first magnet system 24, the inner edge 24*a* of the first magnet system 24; a outer portion of the bisected magnetic gap 5*b*; the voice coil 10 (including the winding 11 and the former 12); the inner portion of the bisected magnetic gap 5*a*; the outer edge 26*b* of the second magnet system 26, the second magnet system 26, the inner edge 26*a* of the second magnet system 26, the outer edge 21*b* of the inner ring 21, the inner ring 21 and the inner edge 21*a* of the inner ring 21. FIG. 3A is an expanded view of the magnetic gap 5, substantially bisected by the voice coil 10 comprising the winding 11 and former 12 into magnetic gap portions 5*a* and 5*b*.

As shown in FIG. 4, the motor assembly 4 comprises a first magnet system 24 and a second magnet system 26. The second magnet system 26 may be concentrically aligned along radial axis 39 inside the first magnet system 24 such that the outer diameter of the second magnet system D26*b* is smaller than the inner diameter of the first magnet system D24*a*. Each magnet system may be made from a plurality of radially polarized arc magnets 28 fixed in an annular ring. The plurality of arc magnets 28 forming the first magnet system 24 may be attached to the inner edge 20*a* of the outer ring 20 (See FIG. 2.) or they may be attached to each other to form an annular ring before attachment to the inner edge 20*a* of the outer ring 20. Similarly, the plurality of arc magnets 28 forming the second magnet system 26 may be attached to the outer edge 21*b* of the inner ring 21 to form an annular ring or they may be attached to each other to form an annular ring before attachment to the outer edge of the inner ring 21*b*. The first magnet system 24 or the second magnet system 26 may be encapsulated in epoxy. The first and second magnet systems 24, 26 may preferably be aligned along the long axis 40.

Continuing with FIG. 4A depicts the magnetic pole arrangement for two of the plurality of arc magnets 28. In this embodiment, the poles are aligned such that a southern pole may be at the outer edge 24*b* of the first magnet system 24, a northern pole may be at the inner edge 24*a* of the first magnet system 24, a southern pole may be at the outer edge 26*b* of the second magnet system 26 and a northern pole may be located at the inner edge 26*a* of the second magnet system 26. In another embodiment, the poles may be reversed for each magnet system. The lines of magnetic flux coupling the two magnet systems are shown in FIG. 4A flowing symmetrically across the magnetic gap 5. A preferred embodiment of the motor assembly illustrated in FIG. 4, may be symmetrically aligned about both its long and radial axes.

Figure 5:
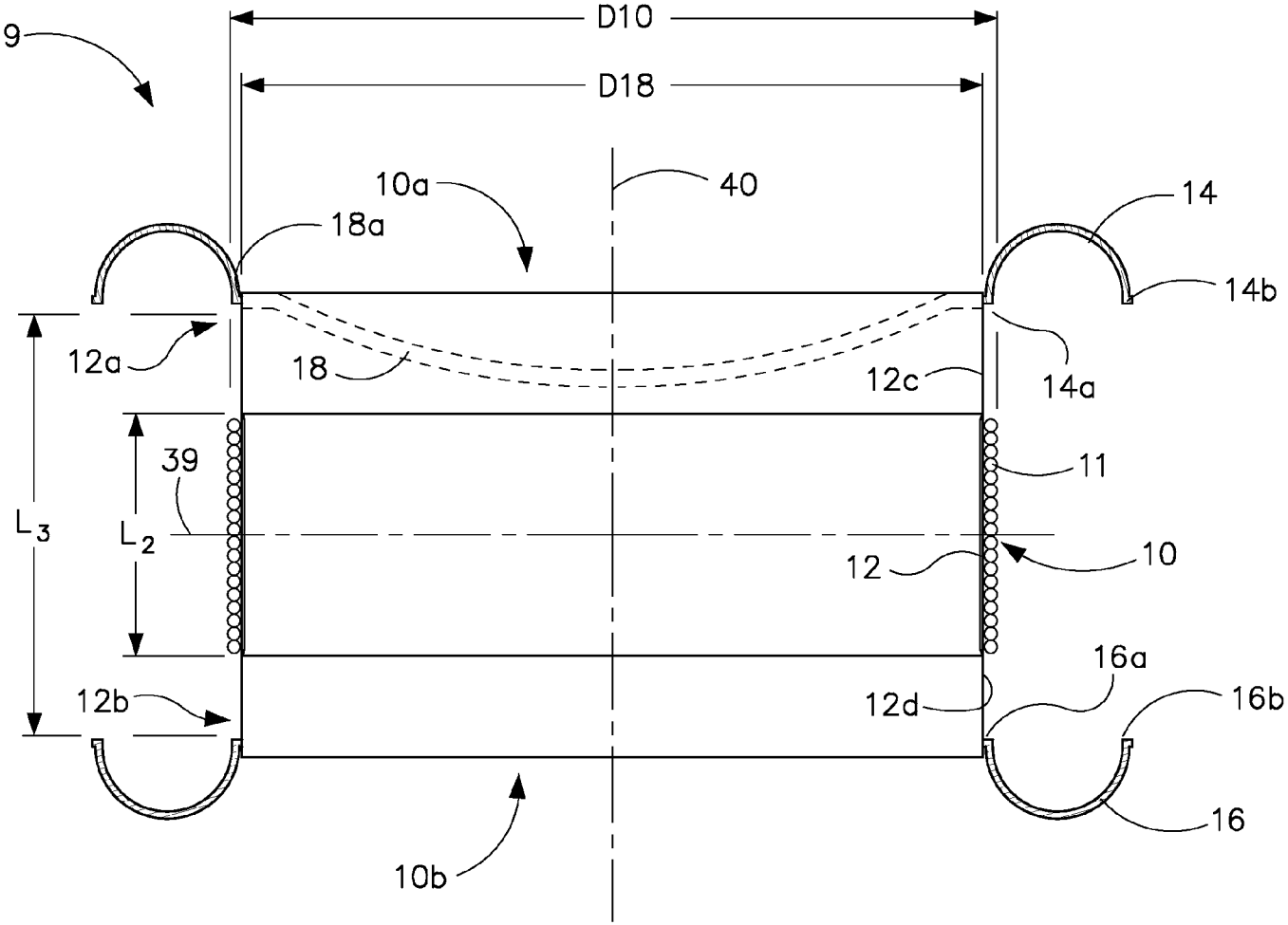
FIG. 5 is a cross-sectional view of an embodiment of a voice coil support assembly of this disclosure.

FIG. 5 is a cross-section view of one embodiment of a voice coil support assembly 9 of this disclosure. The voice coil support assembly 9 comprises the voice coil 10 and opposing upper and lower suspensions 14, 16, which may have a mirror like image with opposing symmetrical shapes about the radial axis 39. The outer edge 14*b* of the upper suspension 14 may be configured for adhesion to a speaker driver frame (not shown), preferably above a motor assembly (not shown). The inner edge 14*a* of the upper suspension 14 may be adhered to the outer periphery 12*d* of the former 12 at the upper end 12*a* of the former 12. The outer edge 16*b* of the lower suspension 16 may be configured for adhesion to a speaker driver frame (not shown), preferably below a motor assembly (not shown). The inner edge 16*a* of the lower suspension 16 may be adhered to the outer periphery 12*d* of the former 12 at the lower end 12*b* of the former 12. Thus, the voice coil 10, which comprises a winding 11 and a former 12, may be supported on its upper and lower ends 10*a*, 10*b* by the upper and lower suspensions 14, 16. The voice coil 10 may optionally have a collar (not shown). For voice coils without collars, the ends of the former 12*a*, 12*b* and ends of the voice coil 10*a*, 10*b* are coincident. The voice coil support system 9 illustrated in FIG. 5, is substantially symmetrical about its long axis 40 and radial axis 39. The length of the winding $L_2$ may be at least twenty percent of the length of the former $L_3$ Preferably the length of the winding $L_2$, may be from about twenty percent to about 90 percent of the length of the former $L_3$. The cone 18, shown in phantom, may be adhered to voice coil support assembly 9 at the inner periphery 12*c* of the former 12 at the upper end 12*a* of the former 12 along the circumferential edge 18*a* of the cone 18. In the illustrated embodiment, the diameter of the voice coil D10 is larger than the diameter of the cone D18.

FIG. 6A is a cross-sectional top view of an outer ring 20 for use in a frame embodiment of this disclosure. The outer ring 20 may be a solid ring configuration (not shown) or may be a hoop and spoke configuration. The outer perimeter of the outer ring 20 may form an outer edge 20*b* of the outer ring 20 that may have optional opening 20*f* (not shown) for fasteners which may be used to attach the outer ring 20 to the shank area 7 of the j-beams 6 of the frame 2 as seen in FIG. 2 to the left of the long axis 40 or the outer ring 20 may be attached to the frame 2 with an adhesive as seen to the right of the long axis 40 in FIG. 2. The outer ring 20 may also have a hoop 20*e* whose inner perimeter forms the inner edge 20*a* of the outer ring 20. A first magnet system 24 (not shown) may be attached to the inner edge 20*a* of the outer ring 20.

Figure 6B:
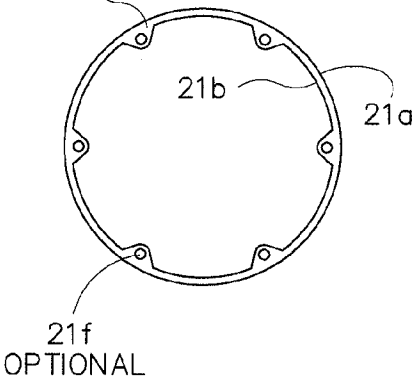
FIG. 6B is a cross-sectional top view of an inner ring of a frame embodiment of this disclosure.
Figure 6A:
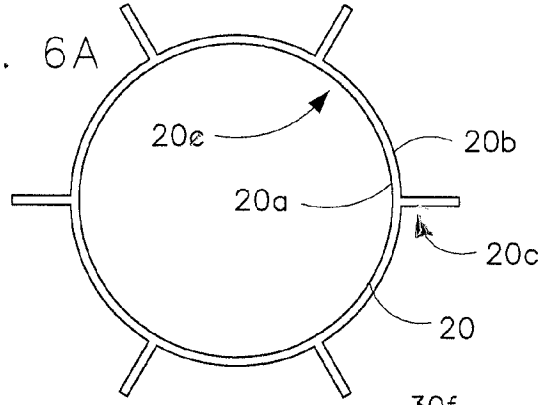
FIG. 6A is a cross-sectional top view of an embodiment of an outer ring of a frame embodiment of this disclosure having a hoop and spoke configuration.

FIG. 6B is a cross-sectional top view of an inner ring 21 for use in a frame embodiment of this disclosure. A second magnet system 26 (not shown) may be attached to the outer edge 21*b* of the inner ring 21. The inner edge 21*a* of the inner ring 21, may have optional openings 21*f* for use with fasteners (not shown) to attach the inner ring 21 to a hook area 36 of the j-beams 6 of the frame 2 (not shown). Alternatively, the inner ring may be adhered to a frame (not shown).

FIG. 6C is a cross-sectional top view of an upper ring 3 for use in a frame embodiment of this disclosure. The upper ring 3 may be adapted for mounting a speaker driver (not shown) to a speaker cabinet (not shown) through the optional opening 3*f* in the ring 3. The upper ring 3 may be integrally formed with a frame (not shown), opening 30*f*, illustrated in FIG. 6C, may be provided in the upper ring 3 which aligns with opening 7*f* in the shank area 7 of the j-beam 6 use with fasteners (not shown) to attach the upper ring 3 to a j-beam 6 of a frame 2 (not shown). The openings 30*f* may be in a polygonal arrangement, for example a hexagon, as seen in FIG. 6C. The inner edge 3*a* of upper ring 3 may be adapted to provide a surface for adhesion of the outer edge 14*b* of the upper suspension 14 (not shown).

FIG. 6D is a cross-sectional top view of a lower ring 22 for use with a frame embodiment of this disclosure. The outer edge 22*b* of the lower ring 22 may be inserted in a recess 7*n* at the lower end 6*b* of a j-beam 6 (See FIG. 6E.) to facilitate arrangement of the j-beams 6 and provide frame rigidity. The inner edge 22*a* of the lower ring 22 may provide a surface for adhesion of the outer edge 16*b* of the lower suspension 16 (not shown).

FIG. 6E is a cross-sectional side view of a j-beam 6 for use with a frame embodiment of this disclosure. The j-beam 6 may have a shank area 7 and hook area 36. The j-beam 6 may also have an upper edge 36*a* atop the hook area 36 and an upper edge 7*a* atop the shank area 7. A recess 7*n* may be formed within the inner periphery 7*d* of the shank area 7 of the j-beam 6 for insertion of the lower ring (See also FIG. 6D). The lower end 6*b* of the j-beam 6 has a base 34 illustrated by the flattened area. The j-beam 6 may have optional openings 7*f*, 36*f* for fasteners.

Figure 6F:
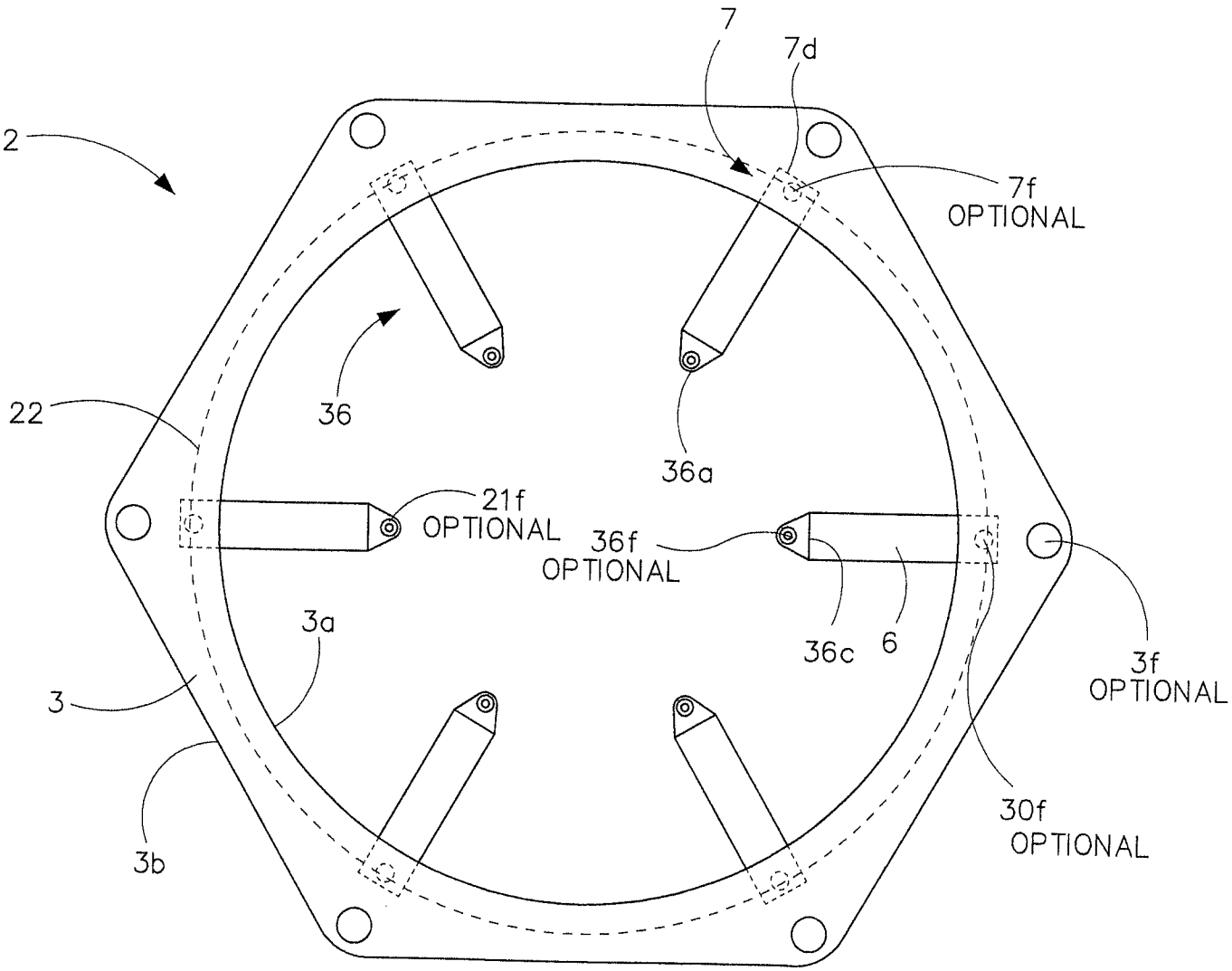
FIG. 6F is a top view of an assembled frame embodiment of this disclosure using six j-beams.

FIG. 6F is a top view of an assembled frame 2 embodiment of this disclosure using six j-beams 6. The j-beams 6 may be held substantially equidistant by the upper ring 3 and the lower ring 22 (shown in phantom) with the hook area 36 of each j-beam 6 arranged inwardly from the outer edge 3*b* and the inner edge 3*a* of the upper ring 3. The shank area 7 of the j-beam 6 is shown in phantom. Optional fastener openings 30*f* and 7*f* and 21*f* and 36*f* may be provided for attaching the upper edge 7*a* of shank area 7 of the j-beam 6 to the upper ring 3 and the upper edge 36*a* of the hook area 36 of the j-beam 6 to the inner ring 21, respectively. Also illustrated is an opening 3*f* in the upper ring 3 for fasteners to mount the speaker driver to a speaker cabinet (not shown).

FIG. 7 The speaker driver frame 2 comprising three j-beams 6, a motor assembly 4 and a magnetic gap 5 are illustrated. The j-beams 6, as depicted in FIG. 6E, may have an upper end 6*a*, a lower end 6*b*, a shank area 7, a recess 7*n* within the inner periphery 7*d* of the shank area 7, and a hook area 36. The lower end 6*b* of the j-beam 6 may have a base 34 illustrated by the flattened area. As shown in FIG. 7, the frame 2 may be assembled using an upper ring 3, a lower ring 22, an outer ring 20 and an inner ring 21. The j-beams 6 are preferably arranged equidistant from each other along a radial axis 39. The upper ring 3 in FIG. 7 may be attached to the j-beams 6 using means known in the art. Openings 30*f* and 7*f*, 20*f*, and 21*f* and 36*f* may be provided for fasteners for attaching the upper ring 3 to the shank area 7 of the j-beam 6, the outer ring 20 to the shank area 7 of the j-beam 6 and the inner ring 21 to the hook area 36 of the j-beam 6, respectively. An opening 3*f* may be provided in the upper ring 3 to mount the speaker driver to a speaker cabinet (not shown). The outer ring 20 may be used to attach the first magnet system 24 along the inner edge 20*a* of the outer ring 20. The inner ring 21 may be used to attach the second magnet system 26 along the outer edge 21*b* of the inner ring 21. The magnetic gap 5 is formed between the first and second magnet systems 25, 26.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure.

I claim:

1. A frame for a speaker driver comprising:

(a) at least three j-beams having air gaps disposed there between, said at least three j-beams having an upper end, a lower end, a shank area, a hook area and a recess, said recess being formed within an inner periphery of said shank area near said lower end of said j-beam, said lower end of said at least three j-beams having a base and an upper end of said hook area;

(b) an upper ring, said upper ring having an inner edge, an outer edge, a top surface and a bottom surface, said upper ring adapted for mounting said at least three j-beams in a polygonal arrangement, said hook areas of said at least three j-beams arranged inwardly of said outer edge of said upper ring;

(c) a lower ring having an inner edge and an outer edge, said outer edge of said lower ring being held within said recesses of said at least three j-beams;

(d) an outer ring having an inner edge and an outer edge, said outer edge of said outer ring attached to said inner periphery of said shank area of said at least three j-beams substantially equidistant from said upper ring and said lower ring; and (e) an inner ring adapted for mounting on said upper edge of said hook area, said inner ring being concentrically aligned with said outer ring.

2. A speaker driver comprising:

(a) at least three j-beams, said at least three j-beams having an upper end, a lower end, a shank area, a hook area and a recess, said recess being formed within an inner periphery of said shank area near said lower end of said at least three j-beams, said lower end of said at least three j-beams having a base and an upper end of said hook area, said at least three j-beams disposed such that said upper end, shank area and lower end create air gaps spaced about a radial axis of said frame;

(b) an upper ring, said upper ring having an inner edge, an outer edge, a top surface and a bottom surface, said upper ring adapted for mounting said at least three j-beams, said hook areas of said at least three j-beams being arranged inwardly of said outer edge of said upper ring;

(c) a lower ring having an inner edge and an outer edge, said outer edge of said lower ring being held within said recesses of said at least three j-beams;

(d) an outer ring having an inner edge and an outer edge, said outer edge of said outer ring attached to said inner periphery of said shank area of said at least three j-beams, said outer ring disposed substantially equidistant from said upper ring and said lower ring;

(e) an inner ring having an inner edge and an outer edge, said inner ring adapted for mounting on said upper edges of said hook area of said at least three j-beams said inner ring being concentrically aligned with said outer ring;

(f) a first radially polarized magnet system attached to said inner edge of said outer ring;

(g) a second radially polarized magnet system attached to said outer edge of said inner ring forming a substantially symmetrical magnetic gap between said first magnet system and said second magnet system;

(h) a voice coil disposed moveably within said magnetic gap, said voice coil comprising a winding and a former, said former having an upper end, a lower end, an inner periphery and an outer periphery;

(i) an upper suspension having an inner edge adhered to said outer periphery of said former at said upper end of said former and an outer edge adhered to said inner edge of said upper ring above a motor assembly;

(j) a cone adhered along a circumferential edge of said cone to said inner periphery of said former at said upper end of said former; and (k) a lower suspension having an inner edge adhered to said outer periphery of said former at said lower end of said former and an outer edge adhered to said inner edge of said lower ring below said motor assembly.

* * * * *